US005335849A

United States Patent [19]

Forbes

[11] Patent Number: 5,335,849

[45] Date of Patent: Aug. 9, 1994

[54] CLOSET RING USED IN A REPAIR FLANGE ASSEMBLY

[76] Inventor: Christopher B. Forbes, 200 W. Hyde Park 15-C, Myrtle Beach, S.C. 29572

[21] Appl. No.: 36,860

[22] Filed: May 10, 1993

Related U.S. Application Data

[63] Continuation-in-part of Ser. No. 719,942, Jun. 24, 1991, Pat. No. 5,246,255.

[51] Int. Cl.[5] ..... F16L 25/00

[52] U.S. Cl. ..... 285/12; 285/24; 285/56; 285/910; 4/252.1

[58] Field of Search ..... 285/24, 12, 56, 15, 285/57, 910, 58, 59, 60; 4/252.1

[56] References Cited

U.S. PATENT DOCUMENTS

| | | | |
|---|---|---|---|
| 712,022 | 10/1902 | Underhill | 285/56 |
| 879,176 | 2/1908 | Jackson | 4/252.1 |
| 938,533 | 11/1909 | Wheeler | 285/58 |
| 1,533,444 | 4/1925 | Mohr | 285/58 X |
| 3,419,298 | 12/1968 | Worley | 285/58 |
| 4,384,910 | 5/1983 | Prodyma | 285/56 X |
| 4,648,139 | 3/1987 | Stokes | 285/56 X |
| 4,886,302 | 12/1989 | Forbes | 285/56 |
| 5,018,224 | 5/1991 | Hodges | 285/56 X |

*Primary Examiner*—Dave W. Arola

*Attorney, Agent, or Firm*—Robert Halper

[57] ABSTRACT

A repair flange comprising members of flat, thin, preferably non-corrosive sheet material dimensioned so as to be flush mounted over finished floor surface. The repair flange is designed to fit around the necks under the attachment rim of various size closet flanges and has an opening offset from the usual circular opening wherein the inner edges of two flange members can be proximate one another, spaced a distance apart or staggered. The flange members wherever their location, fit closely around the neck of the closet flange and the flange body extends over the floor surface beyond the area encompased by the rim of the closet fiancee so that attachment to the floor material can be made beyond the base cf the closet flange. The repair flange primarly adapted to repair floor material directly under the base of toilet bowls which contributes to a snug and tight connection of the toilet bowl to the floor system. A plurality of improved closet rings of substantially the same size and shape as said closet flange and designed to compensate for a situation where the closet flange is below floor level, wherein the rings have affixed to their undersurfaces a circular strip of strong adhesive made of butyl rubber, having a peelable non-adherent protective cover.

22 Claims, 7 Drawing Sheets

FIG. 12
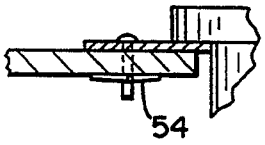
FIG. 12A
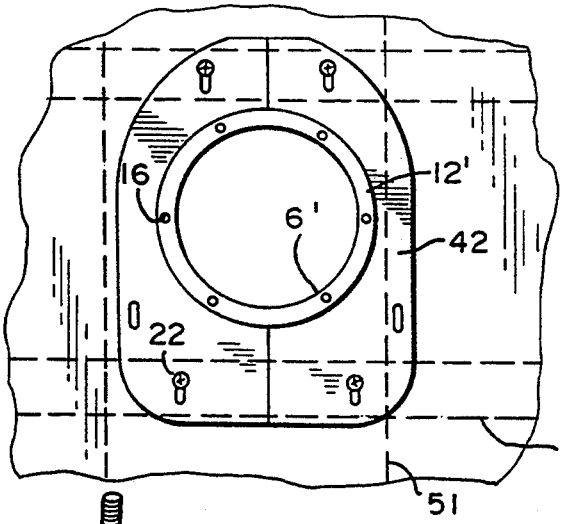
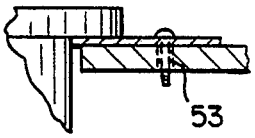
FIG. 12B
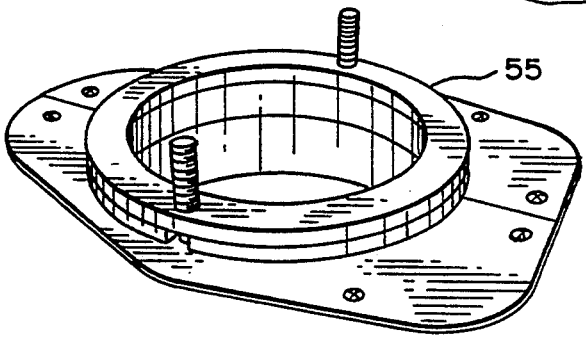
FIG. 13
FIG. 15
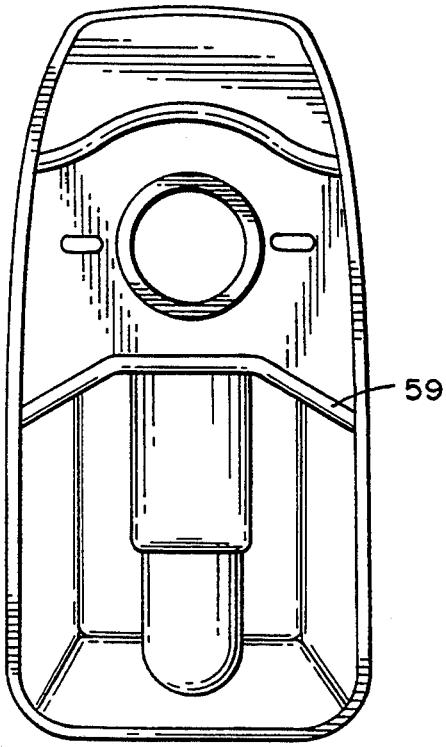
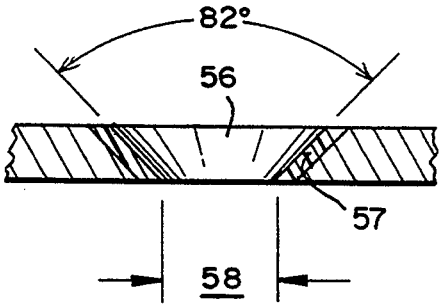
FIG. 14

CLOSET RING USED IN A REPAIR FLANGE ASSEMBLY

This application is a continuation-in part of application Ser. No. 719,942, filed on Jun. 24, 1991 now U.S. Pat. No. 5,246,255 issued Sep. 21, 1993 and directed to Improvements in a Repair Flange.

BACKGROUND AND SUMMARY OF THE INVENTION

This invention is an improvement on my earlier invention for repair flange, U.S. Pat. No. 4,886,302 which issued on Dec. 12, 1989. While the aforesaid invention has been received very favorably, there have arisen situations wherein the design described therein is not adequate for the task.

Like the former invention this invention relates to the attachment of toilet bowls to the floor system where the connection is made to the drain pipe. The purpose and function of the repair flange is described in my aforesaid patent 4,886,302, and that material is incorporated herein by reference.

The improvements in this application are directed to ten items:

1) Offset openings
2) Slots
3) Guide marks stamped into the parts
4) Countersunk spacers or washers
5) Sizing of flange sections
6) Extended Planar surface
7) Modified Planar surface with attached gasket
8) Support board under the flooring
9) Fastening repair flanges to the floor with hollow wall anchors or toggle bolts,
10) Closet rings The improvements in this invention provide a more useful, versatile and effective product that not only provides solutions to common problems outlined in the aforesaid patent regarding the repair of loose closet flanges and toilets, but also address situations where closet flanges are made in a variety of sizes and shapes. In my prior patent the repair flanges were adapted to only one size closet flange. One of the most common problems is the size of a closet flange for different size drain pipes, for example 3 inch and 4 inch drain pipes, the neck of the flanges being about $5\frac{1}{4}''$ to $5\frac{5}{8}''$. Another involves the variable thickness of casting materials that comprise the drain pipe on the neck of a closet flange. The problem arises because the attachment rim of the closet flange is about the same size on all such flanges. Since the screw holes in the rim of a closet flange are located about the same distance from the outside diameter of the flange the screw hole location on the rim of a closet flange with a $5\frac{5}{8}''$ neck is located closer to the drain pipe or neck beneath the attachment rim of the closet flange. For example one type of closet flange has just $\frac{3}{8}''$ between the outer periphery of the screw hole and the neck of the flange. Another type such as a cast iron flange has only $\frac{1}{8}''$ between the neck and the screw hole. On the other hand, the opening between two repair flanges with adjacent inner edges is $5\frac{1}{4}$. In this situation for the repair flange to fit tight against the neck of the closet flange and have proper alignment with the screw holes in the closet flange, it is necessary to offset the opening between the repair flange. Then the overall length from one side of the repair flange to the other would be $7\frac{1}{2}$, the opening between the flanges would be circular and the distance from the inner edge of the closet flange neck to the outside edge of the repair flange would be 15/16". When the repair flanges are adjacent each other at the inner edge, the overall distance would be $7\frac{1}{8}''$ and the opening would be elliptical. In the case of a closet flange with a $5\frac{1}{4}''$ neck diameter, it was found that because of a possibility of misalginment, that it would be preferable to change the circular opening between the repair flanges to an elliptical opening with the major axis vertically oriented and slightly larger than the minor axis. If the situation occurred where the closet flange was seriously misaligned with respect to the toilet bowl base, the best solution in addition to the elliptical opening would be to stagger the repair flanges. It was also recognized that when the inner edges of the repair flanges are adjacent each other, they must not lap. Otherwise there might be damage to the cross webbing under the toilet bowl base, as elevation caused by the lapping would tend to raise the cross webbing and tilt the toilet bowl.

This application is directed to an enhancement of item No. 10 pertaining to the use of closet rings and listed above as one of the approvements of application Ser. No. 719,942. The purpose of the closet ring is to enable satisfactory contact between the toilet bowl and closet flange. As often happens after installation of a new closet flange, this member might well be below floor level. To raise the closet flange to a position somewhat above floor level, a closet ring is placed over the closet flange. Now in many cases one ring per se which measures about $\frac{1}{4}''$ thick is insufficient to raise the closet flange above floor level so that one or more additional rings might be required. Examples of prior art which are directed to this problem are U.S. Pat. Nos. 4,384,910 and 5,018,224. In U.S. Pat. No. 4,384,010 generally a bead of mastic must be applied between the closet flange and the ring described in this Patent as an extension collar, as well as each succeeding ring to establish a good seal. One of the disadvantages of such type sealant is that it takes considerable time for the sealant to take effect so that there is a time lag between the placement of the sealant and the installation of the toilet bowl. Another disadvantage is that a separate container of sealant is required with each set of rings. As an improvement on this device U.S. Pat. No. 5,018,224 claims self sealing stackable collar wherein each collar has a conical opening. Like 4,384,910 the collar is made of resilient plastic and is tapered so that it fits down into a succeeding collar. When the collars are fastened together, there is a seal produced between each collar by virtue of the creation of a wedging effect. Thus there is no need for the use of sealant between the collars. While there is no disclosure to that effect, it is quite obvious that some sealant has to be placed between the first collar and closet flange. Applicant's improvement consists of using a plurality of plastic rings of the type shown in FIG. 13 wherein each ring has affixed thereto an instant bending material that by merely applying pressure instantaneously seals the closet flange and any succeeding ring to each other. The closet rings with the affixed bonding material are packaged with a release strip attached to the bonding material to prevent accidental bonding between the rings. The package also may contain toilet bowls with washers and nuts as well as retainers to hold the bolts in place.

BRIEF DESCRIPTION OF THE DRAWING

The first

FIG. 1 is a perspective top view of the repair flange consisting of a left and right side in accordance with the preferred embodiment of the invention.

FIG. 2 is a perspective view of the repair flange mechanically fastened in place under a closet flange showing toilet bowl attachment bolts and attachment screws in place.

FIG. 3 is a cross-sectional view of the novel repair flange as seen along line 3 on FIG. 1 and line 3 on FIG. 2.

FIG. 4 is a perspective view of the repair flange consisting of a left side and right side in place under a closet flange in perspective location under a toilet bowl.

FIG. 5 is a cross-sectional view of the novel repair flange as seen along line 3 of FIG. 2 in place over a wood floor system. FIG. 5 shows a typical condition where gaps could exist between the floor material and the fastening screw from the closet flange. FIG. 5 shows the repair flange supporting the closet flange bridging past the gap and fastened to the floor system outside the area covered by the closet flange.

FIG. 12 is a plan view showing the repair flange assembly attached to a floor support beneath the floor.

FIG. 12*a* is a plan view showing the repair flange assembly attached to the floor with the use of an anchor bolt. 12*b* is a plan view of the repair flange assembly attached to the floor with the use of a toggle bolt.

FIG. 13 is a perspective view of the repair flange and the closet flange with a closet ring mounted directly to the closet flange for locating the assembly under a toilet bowl.

FIG. 14 shows a countersunk space to be made in a closet flange with an opening that will accommodate flat head screws.

FIG. 15 is a plan view showing the cross webbing that exists under the base of a toilet bowl.

DETAILED DESCRIPTION OF THE INVENTION

The present invention as stated above is directed to an improvement over the repair flange of my patent U.S. Pat. No. 4,886,302. For purposes of comparison and to maintain continuity the features of the earlier patent will be briefly described in accordance with FIGS. 1–5.

Figure 1:
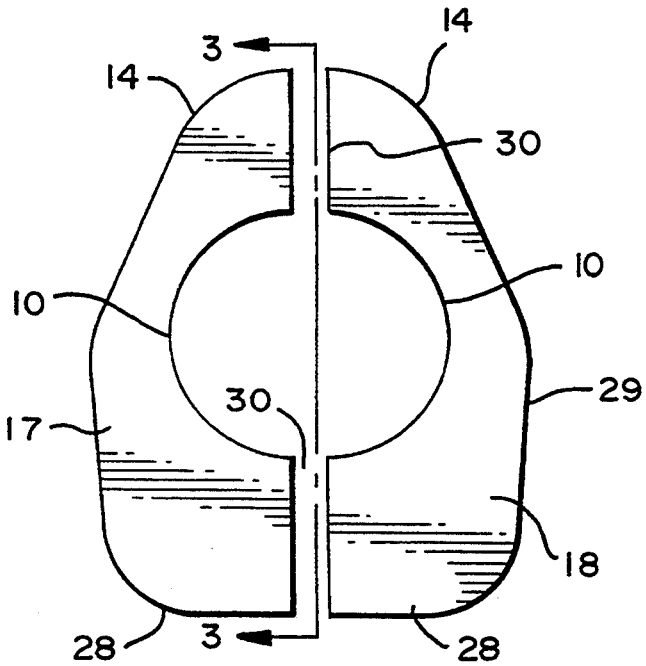
Figure 2:
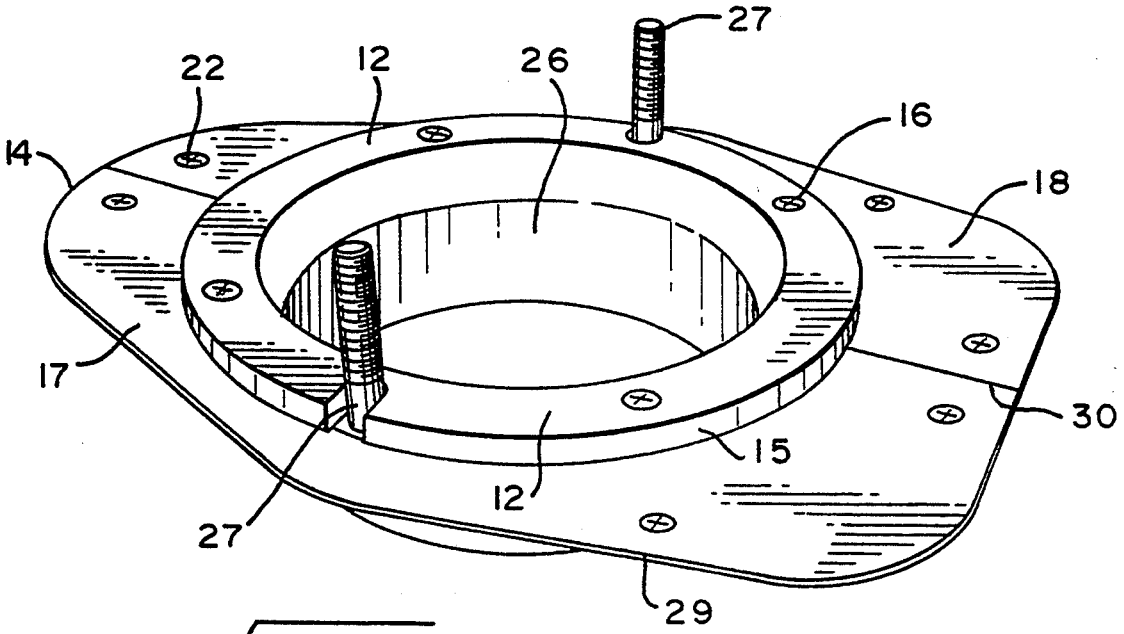
Figure 5:
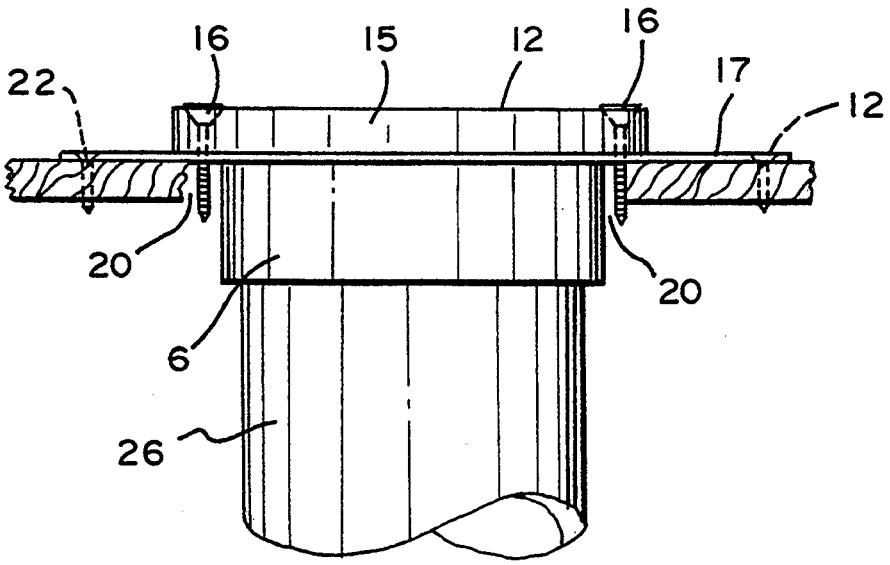

The invention of U.S. Pat. No. 4,886,302 is directed to a flat device consisting of a left and right side as shown in FIG. 1. The two sides left 17 and right 18 are designed to confront one another at the inner edge 30 to form a substantially circular opening 10 that fits in close relationship thereto around the neck of the closet flange 6. The front edge 28 extends out beyond the area covered by the base of the closet flange 12 which enables it to be attached or fastened to the floor material 9 with fastening means such as screws 22 outside the base of closet flange and the opening for the drain pipe 26 shown in FIG. 5, The circular edge 10, being in close relationship thereto fitted around the neck of the closet flange provides a strong and rigid surface under the attachment rim of the closet flange, This allows for a secure connection with the screw 16 located in the attachment rim of the closet flange even when a gap 20 exists between the floor material and the attachment screws located in the rim of the closet flange, The repair flange provides an attachment surface in situations where the floor material does not provide sound gripping for the attachment screws. FIG. 5 shows gap 20 existing between the closet flange and the edge of the floor material.

Figure 3:
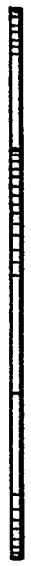
FIGS. 1–5 are duplicate of those shown in my prior patent as a means of comparison.

The device provides a rigid and sound surface when inserted between the closet flange and the floor material. The repair flange is fastened to through the closet flange with conventional fastening screws into the floor material outside the floor surface covered by the closet flange. The device is made from thin flat sheet material as shown in FIG. 3 and on the cross-sectional view of FIG. 5, This feature enables the device to be installed without disconnecting the closet flange from the drain pipe.

Figure 4:
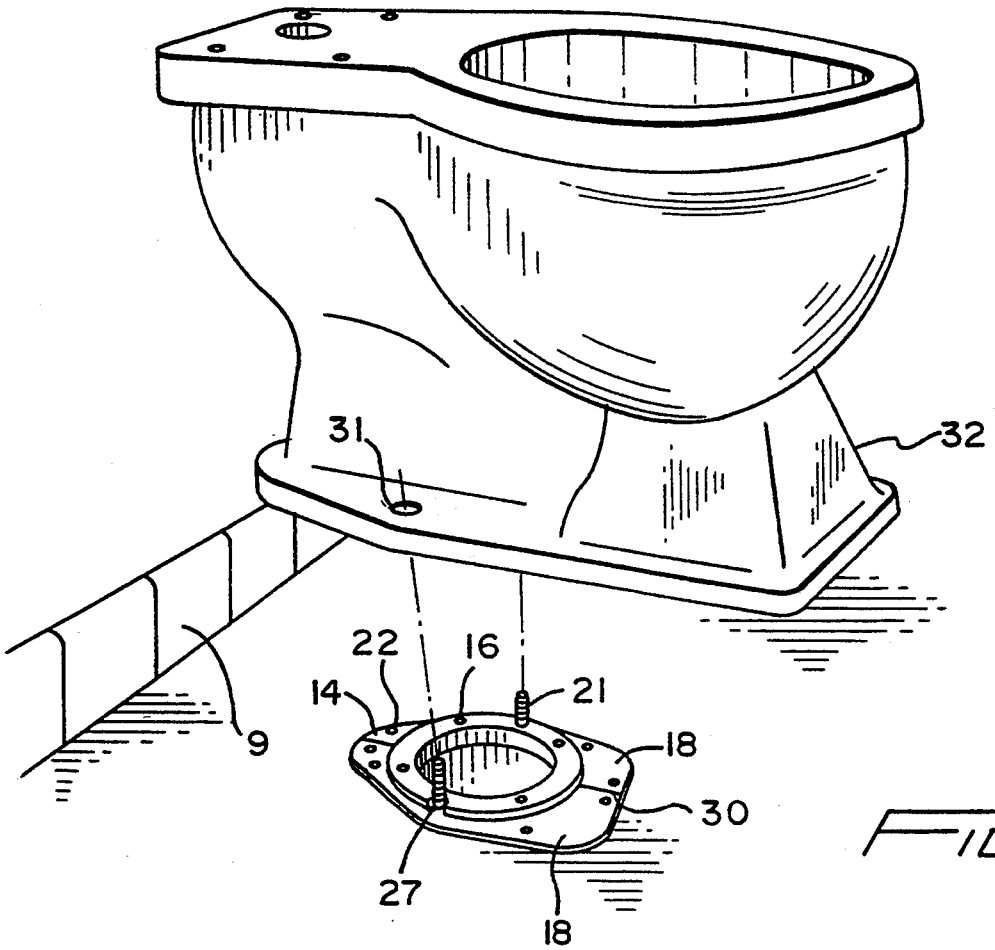

The repair flange is shaped so that it will be completely contained within the toilet bowl base 32 as illustrated in FIG. 4, The device provides a base for the toilet bowl attachement bolts 27 which are normally fastened through the opening in the base of the toilet bowl 31.

Figure 6:
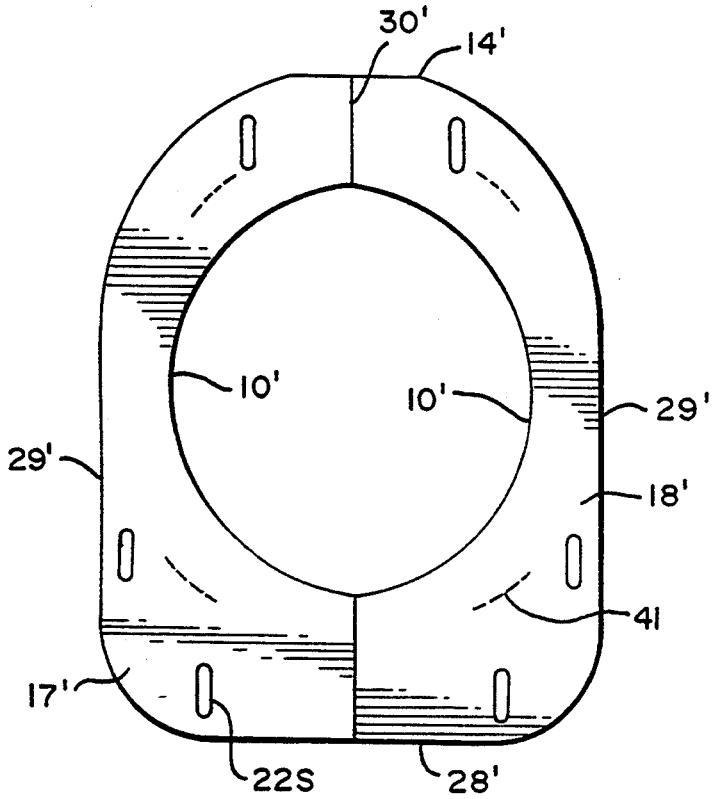
FIG. 6 is a plan view of showing the repair flanges in closed condition wherein the opening is shown as elliptical as opposed to a circular opening in the U.S. Pat. No. 4,886,302.

FIG. 6 shows the preferred shape of the invention which consists of two parts of thin, flat sheet material, preferably non-corrosive, having a straight front edge 28' rounded at their ends and extending vertically upoward about two-thirds the length of the sheet to form respective left and right sides 17' and 18'. The sheet then extends arcuately upward and inward to back edge 14'. The arc ends about one inch from edge 30' where the sheets confront one another and when in closed formation form an elliptical opening 10'. The figure also shows alignemnt marks 41 spaced in four symmetrical positions about the flanges.

Figure 7:
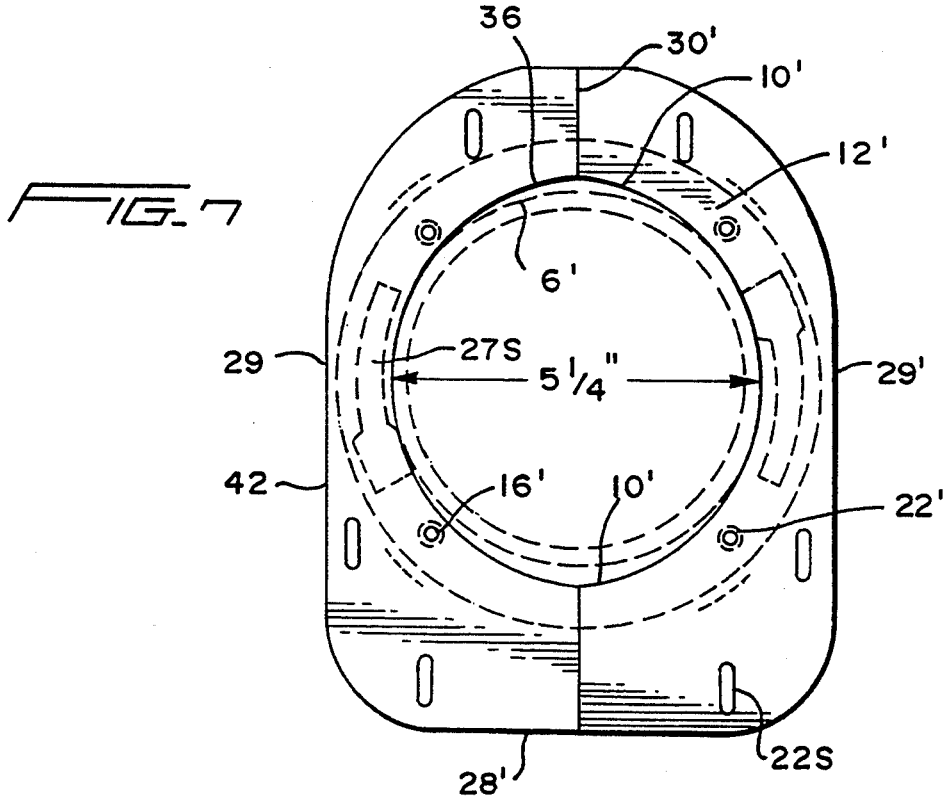
FIG. 7 is an embodiment of the improvement showing a plan view of the repair flange closed around the neck of a closet flange having an neck size approximately $5\frac{1}{4}''$ in diameter.

FIG. 7 shows the repair flange fitted snugly about a closet flange having a neck diameter of about $5\frac{1}{4}''$. Normally the neck is about 3 or 4 inches so that there is no problem in placing the repair flanges under the closet flange. However, when the neck is $5\frac{1}{4}''$ and the standard repair flange circular opening is about the same, the use of an elliptical opening for the repair flanges permits a much easier fit. Preferably the elliptical opening is made so that the major axis runs vertically and the minor axis runs horizontally. Alignment marks 41 are arranged to assist in centering the repair flange parts around the neck and under the rim of the closet flange. By using the guide marks an equal amount of fastening surface under the screw holes of the closet flange rim is assured. Screws 16' fit into screw holes 22' and fasten the closet flange 12' to the repair flange sections 42. 22s represents slotted holes two of which are located near edge 28' on respecitve sides 17' and 18' and two at the back edge. 14'. The slots afford latitude for shifting the flange sections either in front or back directions so that the flange sections fit properly under the screw holes, thereby enabling a rigid solid fastening surface to the floor. Additionally because of the ability to adjust fastening locations, obstruction of the cross webbing under the toilet base avoided. Slots also allow the flange sections to be used on either the left or right side as well as being flip-flopped. The significance of this feature is that screw holes in closet flanges are rarely opposite one another as is the case where threads strip out of the repair flange sections. 27 are bolts which are fastened to the base of the toilet bowl through opening 31. 36 shows the gap that exists between the circular neck of the closet flange and the elliptical opening between the flange sections when the flange sections are fitted close around the closet flange.

Figure 8:
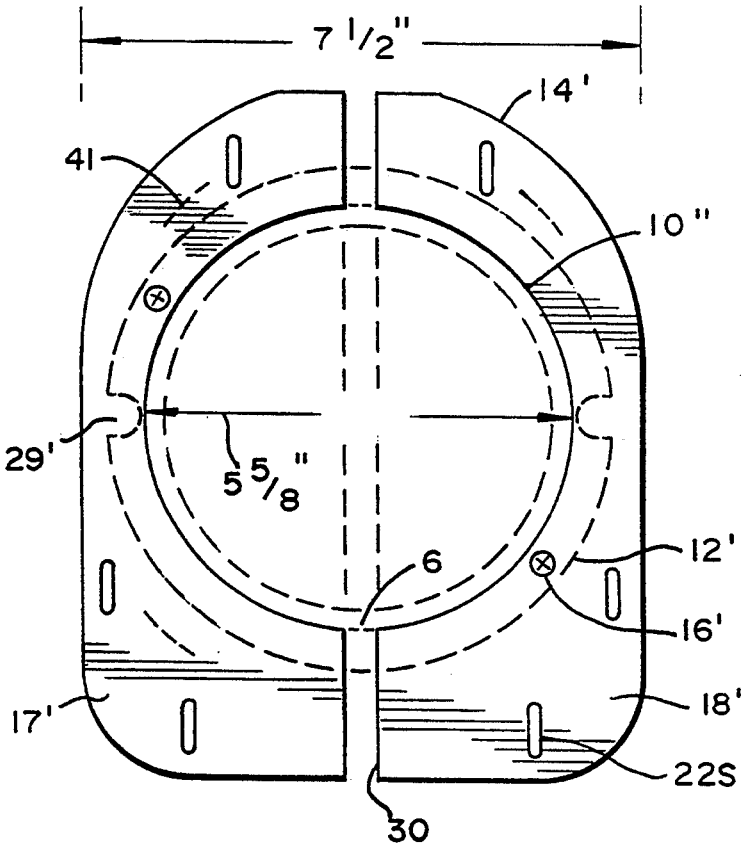
FIG. 8 is another embodiment showing a plan view of the repair flanges spaced apart to accommodate a closet flange of about $5\frac{5}{8}''$ diameter.

FIG. 8 is illustrative of the situation where the neck of the closet flange is $5\frac{5}{8}''$. The flanges must be offset to accommodate the larger neck and the opening now reverts to a circular one. The overall length the flange sections from side 17' to side 18' is now approximately $7\frac{1}{2}''$. Even with the flanges offset, there is still sufficient space that the flange sections with the aid of the guide marks will be located under the screw holes of the closet flange with adequate fastening surface.

Figure 9:
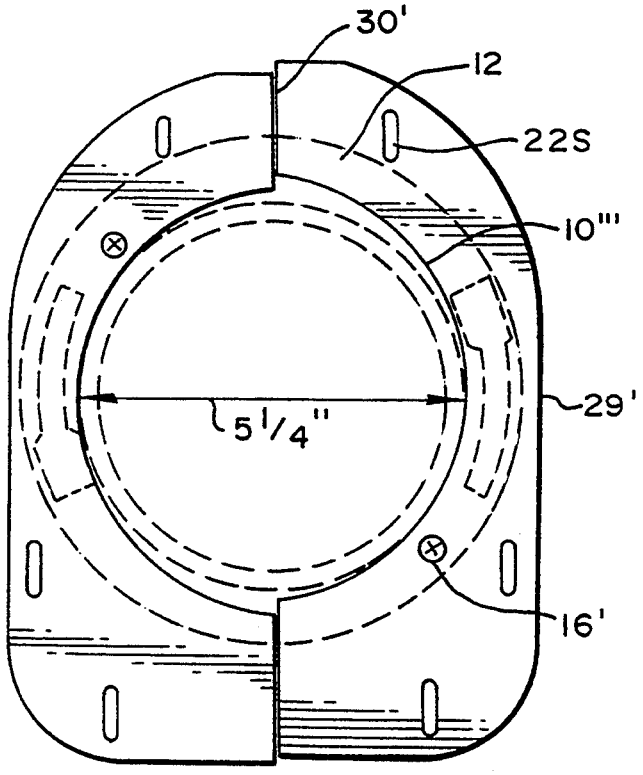
FIG. 9 is a third embodiment of a plan view showing the repair flanges closed around the $5\frac{1}{4}''$ diameter neck of a closet flange wherein the repair flanges are staggered.

FIG. 9 shows an embodiment wherein the repair flanges need to be staggered to accommodate am approximately $5\frac{1}{4}''$ closet flange. Staggering is necessitated by the fact that the closet flange is considerably misaligned from its usual position with repect to the location of the screw holes through the rim of closet flange. Staggering of the repair flange sections allows adequate coverage under the screw holes located in the closet flange. This staggering in conjucntion with the use of slotted holes in the repair flanges makes for an easier and more rapid assembly. As in FIG. 7 the repair flange sections form a close fit around the closet flange neck and the opening between flange sections is 10'''.

Figure 10:
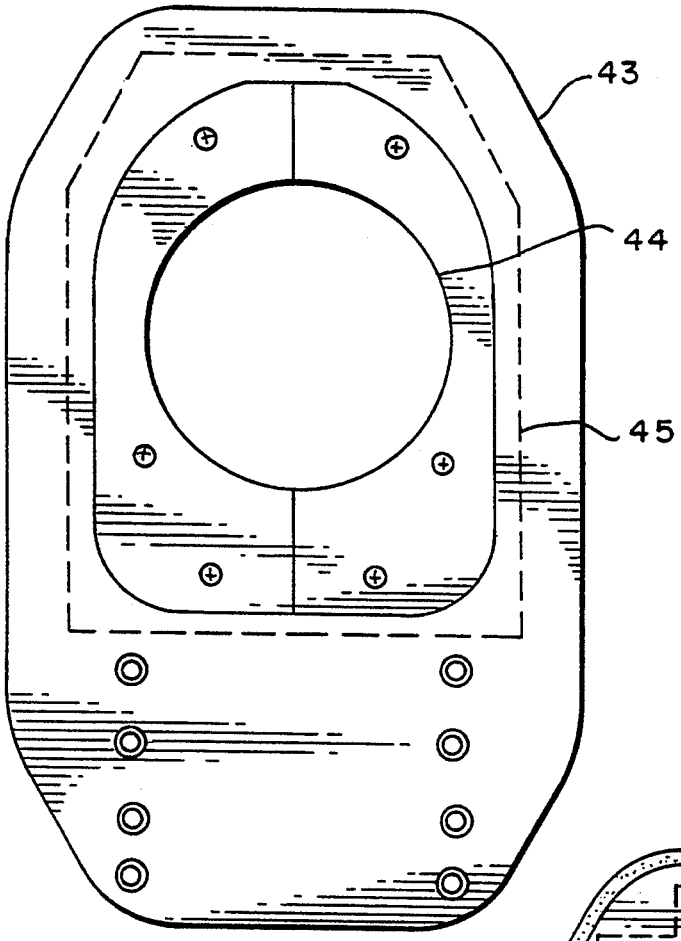
FIG. 10 is a fourth embodiment showing the addition of a planar surface to the repair flange.

FIG. 10 shows an embodiment wherein the surface of the repair flange is extended by attachment of an enlarged planar surface 43. This surface is generally rectangular, rounded at the ends and is about two feet in length and about one foot in width and somewhat thicker than the repair flange. About a quarter of the distance from the top edge and medially of the sides is a circular opening 44 just large enough to fit around the rim of the closet flange. On the underside, surrounding the circular opening is a recess 45 into which the raised repair flange fits. On the upper side of the surface are a series of countersunk fastening holes. Four of these holes are located so as to enable fastening the surface to the repair flange and make it an integral part thereof. The other openings enable fastening to the existing floor. These openings could also consist of holes or grooves or slots, etc. Optionally the same fastening means that fasten the repair flange to the flooring could also be used to fasten both the extended planar surface and the repair flange to the flooring. This includes adhesives, epoxies and liquid glues. The extended surface not only provides greater support for weak flooring but also serves as a cover plate. Sometimes it is necessary to change toilet bowls, which may be of different dimensions than the original. There would thus be gaps between the toilet bowl edge and the flooring. Since the extended surface is greater than the perimeter of the toilet bowl, the extended surface would cover these gaps.

Figure 11:
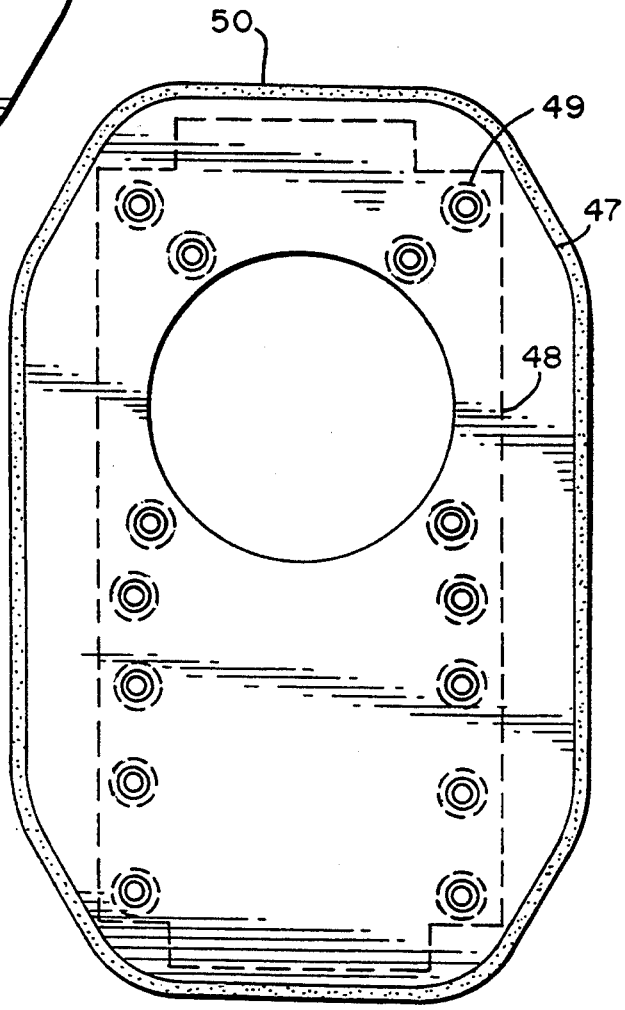
FIG. 11 shows a modified planar surface with a gasket attached to the rim and spacers attached to the underside.

FIG. 11 is a modification showing the planar surface 47. The bottom of this surface has a recessed area 48 generally rectangular but extending both longitudinally and laterally for all the surface but a narrow strip at the respective edges and sides of the surface. The purpose of this modification is to take care of a situation where there is uneven flooring. An unrecessed planar surface over uneven flooring would likely create rocking of a fastened assembly because of high spots on the floor. By the same token low spots would make fastening of the surface to flooring difficult. In addition to the countersunk spacers in the previously described floor surface, there are additional holes spaced longitudinally along each side of the surface. Beneath each of these holes is placed a spacer 49 which can be molded to the underside, secured by an adhesive or placed under the hole manually. The spacer not adjusts leveling of the extended surface with the flooring, but also prevents cracking or breaking of the planar surface, which occurs as a result of the pressure applied when torquing the fastening means. These spacers or protrusions can also be sanded individually to allow for isolated high spots in the floor. Additionally, around the periphery of the extended surface is adhesively attached a gasket 50 which would be of the pressure resistant flexible type. The purpose of the gasket is to compensate for any unevenness in the surface where the extended surface joins the flooring.

FIG. 12 shows a board 51 installled under the floor and attached to joists 52. In some areas attachment of the repair flange to the flooring is inadequate to support the assemnbly, because the floor surface is too weak for the screws to make good contact. By placing a board across the joists under the floor, the screws create a sandwich effect with the flooring held firm between the repair flange and the board. On the other hand if joists are inacessible or repair is made in a mobile home, the solution would be to secure the flooring to the repair flange with either one of hollow wall anchors 53 or toggle bolts 54.

Figure 13A:
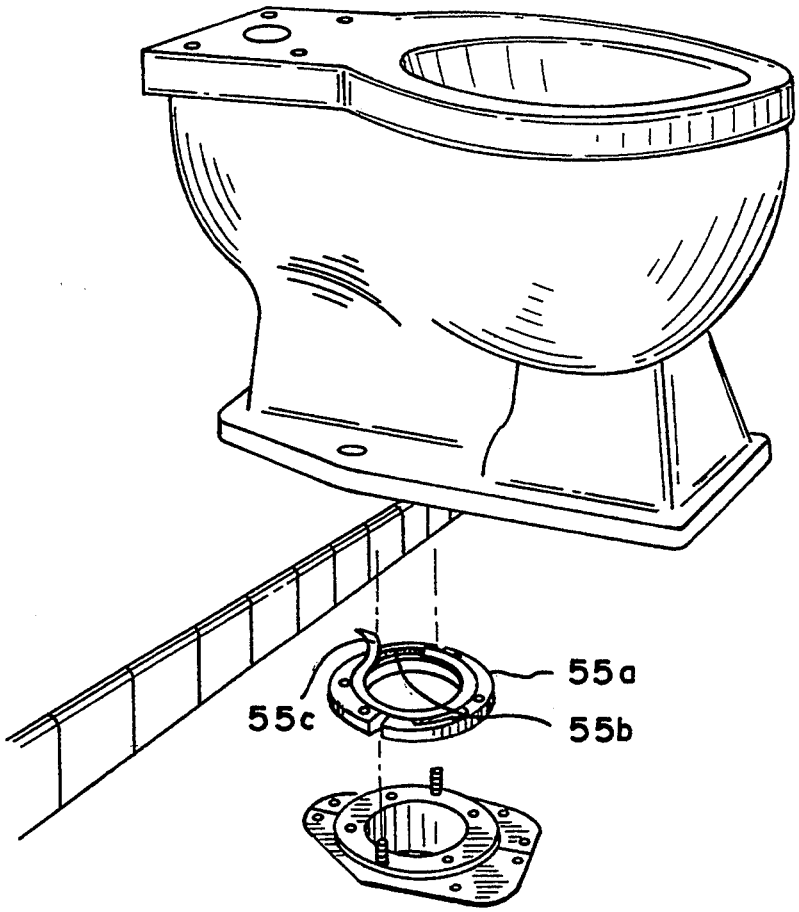
FIG. 13*a* is a view showing the special construction of the closet ring.
Figure 13B:
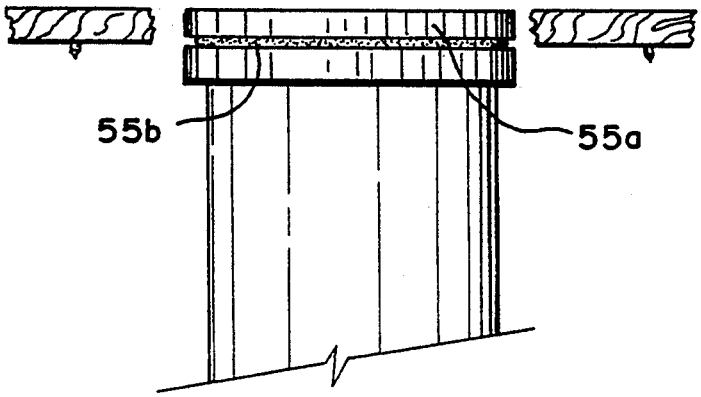
FIG. 13*b* shows an assembly of the closet flange below floor level with the especially constructed closet rings added to raise elevation above floor level.

FIG. 13 shows a closet ring 55 fastened and sealed directly over the closet flange. The closet ring is the same size and has the same geometry as the closet flange, except that as the name implies, it has no neck. Generally the horn of the toilet bowl fits over the rim of the closet flange and is held tight by the application of sealant, but on occasion it happens that the closet flange is somewhat depressed with respect to the floor and repair flange to which it is fastened or else the horn of the toilet bowl is somewhat elevated. By placing a closet rind over the closet flange, the horn of the toilet bowl and the closet flange can be successfully joined without voids that would cause leakage.

FIG. **13*a* shows a closet ring 55*a*. The closet ring has the same geometry as closet rind 55. Additionally, affixed to the under surface this rind is a circular band of instantaneously bonded material 55*b*. This material is applied by placing a plurality of closet rinds on a conveyor belt and passing the belt according to a pre-set timing arrangement below a extruder having a circular slot. The slot is about 4½ diameter so that the bonding material will be extruded as a band which overlaps the opening of the ring by about ½". To expedite delivery of the bonding material the extruder is heated sufficiently so that the bonding material is not too viscous. The extruder is calibrated to deliver a band about ¼" to ⅜" thick. After the bonding material has sufficiently cooled a circular release strip 55***c* is placed over the bond and a plurality of rinds are packaged along with 3½" toilet bolts, washers, nuts and retainers. The bonding material is a dark heavy substance manufactured by the 3M Company and is similar to the bonding material used in the automotive industry to seal fittings, housing joints an to bond car mouldings in place. The bonding material is a flexible, non-hardening unshrinkable, waterproof, soft solid that possesses strong adhesive qualities. Chemically, it is classified as a butyl rubber and contains 10–20% polybutylene and 1–10% isobutylene-isoprene polymer along with number of additives and fillers such as amorphous silica, titanium oxide, calcium carbonate, kaolin, etc. While these closet rings are intended to be used with applicant's repair flange assembly, they could also be applicable in any situation where only closet rings would be required.

FIG. 14 shows the type of hole used in the closet flange through which the screws are inserted to fasten to the repair flange sections. Unlike patent 4,886,302 that used fastening screws 16, 16*s* are flat head screws which are mounted in countersunk spacers 59 surrounded by tapered washers 53 preferably made of nylon, and passing through opening 57. This use of tapered washers allows the same size screw for both small and large countersunk attachment holes. The nylon washers cushion the self tightening screw when tightening with power fasteners. The cushion also helps prevent stripping threads in the repair flange sections as the self tapping screw draws the closet flange near to the repair flange section. These washers also act as spacers to keep the screw from making contact the screw holes in the closet flange to the repair flange past the threads created by the tapping screws.

FIG. 15 shows the cross webbing that exists under the bas e of a toilet bowl, As pointed out none of the flange sections in the emodiments represented by FIGS. 7 or 9 should lap lest they cause an obstruction to the cross webbing and the supporting edges under the base of the toilet bowl. The use of slots in the repair flanges also allows adjustments in screw location that might also obstruct the cross webbing. However, even after screws are installed, they can be loosened so that the flange sections can be shifted, The foregoing detailed description of the invention clearly demonstrates the advantages and improvements of this invention over prior patent, These include versatility and adaptability to various size closet flanges, ease of locating the repair flange sections with respect to the closet flange and more secure fastening amongst other things.

I claim as follows:

1. In combination with a closet flange having a neck and a plurality of circumferentially spaced screw holes and a floor surface supporting a toilet bowl base thereon such as commonly found in bathrooms, a repair flange anchored to the floor and secured to the underside of an attachment rim of the closet flange and becoming an integral part of the closet flange so as to extend the anchoring surface of the closet flange over a larger area of said floor surface that exists under the toilet bowl base and received over gaps in deteriorated and poorly cut openings underneath the attachment rim of said closet flange, said repair flange comprising substantially rigid, flat sheet flange members of predetermined shape, each member having an outer, peripheral edge portion which comprises a front, back and side edge, said edges being dimensioned that each flange member is contained within the base of the toilet said flange members also including inner edge portions defining a substantially elliptical opening so that said flange members can accommodate closet flanges of various sizes and shapes, said inner edge portions located medially between said respective outer peripheral edges, said inner edge portions surrounding in close relationship thereto the neck of said closet flange underneath said rim of said closet flange, the flange members fitting neatly under the screw holes of the closet flange, said repair flange members having a plurality of vertically oriented slots spaced in said flange members, fastening means engaging said flange members through said slots to secure said flange members to said underlying floor surface, a plurality of arcuate guide marks located to be radially outward from the rim of the closet flange, countersunk spacers and washers adjacent thereto radially spaced around the rim of said closet flange for accommodating fasteners that secure said closet flange to said flange members, a closet ring having a circular opening and the same dimension and shape as the closet flange is fastened proximate the closet flange, said toilet bowl base having a horn fitted directly on said closet flange and sealed, the improvement wherein said closet ring has an under surface and having fixed to said under surface a circular band of instantaneous bonding material, said band extending about a half inch beyond the diameter of said circular opening, said closet ring being covered with a release strip of the same diameter as said bonding material, said release strip being removed just prior to use.

2. The combination of claim 1 wherein said fastening means are screws, said fasteners are flat head screws and said flange members are non-corrosive.

3. The combination of claim 1 wherein the inner edges of said flange members are spaced from each other a sufficient distance to accommodate a larger neck flange than flange members whose inner edges are proximate one another, said flange members being arranged to fit in close relationship with the neck of the closet flange.

4. The combination of claim 3 wherein the neck diameter of the closet flange is about 5⅝" and the overall dimension from side to side is about 7½".

5. The combination of claim 1 wherein the inner edges of said flange members are proximate each other and staggered around the neck of a closet flange that is offset with respect to the location of the toilet bowl base, said staggering enabling adequate fastening space under the screw holes in the closet flange.

6. The combination of claim 5 wherein said flange members extend arcuately inward from said vertically upper sides to a point at the back some distance from said inner edge, then extend horizontally to said inner edge and vertically downward to said opening.

7. The combination of claim 1 wherein the major axis of the elliptical opening runs vertically between the inner edges of said flange members and said minor axis runs horizontally from a line drawn medially between the sides of said flange members, the neck diameter of the closet diameter is about $5\frac{1}{4}''$ and the overall dimension from side to side of said flange members is about $7\frac{1}{2}''$.

8. The combination of claim 1 wherein said flange members have horizontal front edges substantially rounded at the ends and sides that extend vertically upward for about two-thirds the height of said flanges.

9. The combination of claim 1 wherein said slotted flange members are designed to be interchangeable,

10. The combination of claim 9 wherein said washers are flat and are formed of nylon and said countersunk spacers and said flat nylon washers adjacent thereto are radially spaced around the rim of the closet flange for accommodating flat head screws that secure said closet flange to said flange members, said nylon washers assuming the contours of said countersunk spacers when said screws are torqued.

11. The combination of claim 1 wherein the anchoring surface of said repair flange is extended by fastening a substantially rectangular planar member about a quarter inch thick thereto, said planar member having a substantially circular opening that surrounds the closet flange, a plurality of spaced countersunk holes, through which the screws are inserted and a rectangular recessed area on the underside for fitting said planar member over said repair flange so that said planar member will be level with the floor surface, said planar member extending a considerable distance beyond the edge of the toilet bowl base.

12. The combination of claim 11 wherein the underside of said planar surface is recessed for a substantial distance both longitudinally and laterally beyond the region of the repair flange a plurality of countersunk holes spaced longitudinally on each side of said surface and a plurality of spacers located directly beneath said hole, said spacers being about the thickness of said recess, fastening means for securing said planar surface to the flooring in said recessed area beyond the region of the repair flange, said planar surface having an outer edge and a flexible pressure type gasket adhesively joined to said outer edge.

13. The combination of claim 11 wherein the recessed area of the planar member includes dimples over the slots of the repair flange to accommodate raised fasteners.

14. The combination of claim 13 wherein said raised fasteners are raised screws.

15. The combination of claim 13 wherein said raised fasteners are hollow wall anchors.

16. The combination of claim 1 wherein a board of substantial thickness is fastened between joists and said flooring is sandwiched between said board and said repair flange by extending said fastening means through said board.

17. The combination of claim 1 wherein there are a plurality of said closet rings, said closet rings compensating for a situation wherein said closet flange is below floor level.

18. The combination of claim 17 wherein said release strip is made as two symmetrical semi-circular segments.

19. The combination of claim 17 wherein said instantaneous bonding material is an unshrinkable, waterproof, non-hardening, soft, flexible material.

20. The combination of claim 19 wherein said material is a butyl rubber containing additives and fillers, wherein said material can be pried apart from an adjacent ring to which it has been bonded and reused.

21. The combination of claim 1 wherein said means fastening the repair flange to the floor are hollow wall anchors.

22. The combination of claim 1 wherein said means for fastening the repair flange to the floor are toggle bolts.

* * * * *